US005622031A

United States Patent [19]

Meives

[11] Patent Number: 5,622,031

[45] Date of Patent: Apr. 22, 1997

[54] PACKAGING MACHINE WITH ROTATING PUSHER BAR

[75] Inventor: Michael Meives, Reedsville, Wis.

[73] Assignee: Nigrelli Systems, Inc., Kiel, Wis.

[21] Appl. No.: 553,746

[22] Filed: Oct. 23, 1995

[51] Int. Cl.[6] ..... B65B 5/10; B65B 39/14

[52] U.S. Cl. ..... 53/473; 53/251; 53/534

[58] Field of Search ..... 53/473, 534, 251, 53/250, 258, 543, 475, 255

[56] References Cited

U.S. PATENT DOCUMENTS

| | | | |
|---|---|---|---|
| 3,141,274 | 7/1964 | Nigrelli et al. | 53/534 X |
| 3,466,834 | 9/1969 | Standley et al. | 53/534 X |
| 3,599,397 | 8/1971 | Standley et al. | 53/534 X |
| 3,783,584 | 1/1974 | Rauser | 53/534 |
| 4,332,121 | 6/1982 | Nigrelli | 53/251 |
| 5,056,298 | 10/1991 | Deadmond | 53/534 |
| 5,241,805 | 9/1993 | Johnson | 53/251 X |

*Primary Examiner*—James F. Coan
*Attorney, Agent, or Firm*—Francis J. Bouda

[57] ABSTRACT

In a machine for packaging individual items such as 6-packs of beverages into a container, the containers are moved along a lower conveyor and the items are moved along an upper conveyor. A pusher bar pushes the items off the upper conveyor whereupon they drop by gravity into the containers. Shortly before the items begin to fall, the pusher bar rotates frictionally against the back of the item whereby that the falling speed of the back of the item as it leaves the upper conveyor is increased so that both the backside and the frontside of the item drop into the container with the sides vertically aligned.

8 Claims, 2 Drawing Sheets

PACKAGING MACHINE WITH ROTATING PUSHER BAR

BACKGROUND OF THE INVENTION

It is well-known in the art of packaging equipment to provide a corrugated cardboard carton or case which will accept, for packaging, a plurality of packaged items. Although the invention of the present application has many applications and uses, it is particularly adapted for loading a cardboard case with four 6-packs of beverages, such as bottles of beer.

It is customary in the beverage trade to sell the beverages in units of 24 bottles or cans to a container, and although some distributors provide trays or cases in which all 24 units are individually placed into the container, nevertheless, it is desirable to have the bottles in units of 6 called "6-packs" and four of these 6-packs are loaded into a cardboard case at the packaging plant after the bottles have been placed into the individual 6-pack carriers.

This type of operation is done extremely rapidly at the bottling and packing plant, many times at the rate of 960 bottles per minute or 16 bottles every second.

The assembly line receives those bottles from the bottling machine, and they are first packed in a 6-pack carrier in two rows of three bottles each, all as is well-known in the art.

The next step is to get these 6-packs into a cardboard carton or box, and to do that the 6-packs are fed in groups of four to an upper conveyor of a well-known packaging machine, quite often referred to as the "Diplomat" packing machine.

In a separate operation, the Diplomat machine accepts an erected cardboard carton and moves it on a lower conveyor, empty, and with top flaps open (or a carton with no top flaps) at an incline underneath the upper conveyor line.

The groups of four 6-packs are moved by a pusher bar along a load plate or dead plate above the carton, until the leading corner of the leading 6-pack, being pushed by a pusher bar, catches the inside of the front panel of the carton and drags the carton along with it.

In one embodiment the carton is detained by a stop, with the front panel slightly beyond the edge of the dead plate, and then the 6-pack's forward movement carries the carton past the stop. In another embodiment the movements of the carton and the 6-pack can be timed so that the front panel of the carton and the leading edge of the 6-pack are in proper relative position and it is not necessary for the 6-pack to force the carton past the stop. In another embodiment appropriate timeing devices can be used so that the conveyor carrying the 6-packs can trip the stop rather than rellying on the movement of 6-pack box to do the tripping.

The 6-packs are thus moving above and along with the carton, and when the 6-packs pass the edge of the dead plate, they fall by gravity into the carton. In order that the bottles are not broken or the 6-pack holders are not damaged, or the carton is not also damaged, a sliding friction gripper mechanism called a "SOF-LOAD" lightly squeezes the sides of the carton and the 6-packs therein as they drop into the carton.

Because the economies of scale in operation require that the minimum amount of cardboard or packaging material be used, all commensurate with satisfactory and sufficient strength and stiffness, etc., it is necessary that the four 6-packs fit snugly into the carton. Therefore, there is a minimum of clearance between the inside surfaces of the cardboard carton and the outside surfaces of the 6-pack holders.

Quite often the first two 6-packs in the group of four which are pushed off the dead plate are lowered satisfactorily into the carton.

However, because the first two 6-packs drop off the dead plate before the following two 6-packs do, quite often the leading edge of the following two 6-packs are jammed between the upper rear edge of the leading two 6-packs before the trailing edge of the following two 6-pack containers are positioned within the rear edge of the cardboard container.

This unfortunate circumstance causes the following two 6-packs to be "cocked" at an angle between the upper edge of the rear of the first two 6-packs and the upper edge of the rear panel of the carton.

When this happens, excessive damage, confusion, and loss of operating time occur until the mis-aligned cartons and 6-packs and bottles are removed from the conveyor line.

This problem is exacerbated when, in the economics of the operation, the specifications for the cardboard carton require use of lighter weight corrugated board generally referred to or specified by the "basis weight" of the corrugated board.

By using 125 lb. board in the cartons versus 200 lb. board in the cartons, a savings of as high as $360 thousand per line, per shift, per year can be realized.

In order to prevent the "cocking" of the 6-packs as they drop into the carton, the unique arrangement of the present invention has been developed as an improvement on the Diplomat packaging machine.

It is to be understood that although the present invention is particularly directed to the packaging of bottles of beverages such as beer, soft drinks and the like, it is equally applicable to the handling of any pre-packaged units which may be cans as well as bottles, and which may be foodstuffs, as well as beverages.

It is also to be understood that although reference is made to "6-packs" as units, the "units" may be single cans or bottles or containers of various sizes such as 8 oz. of 12 oz. cans or bottles or ½ gallon or gallon milk containers or the like.

OBJECTS OF THE INVENTION

Therefore, one object of the present invention is to provide a packaging machine which improves the efficiency of loading individual units into a larger container.

A further object of the present invention is to provide a pusher bar assembly which prevents the cocking of individually packed units against one another when lowered into a larger container.

More specifically, an object of the present invention is to improve the speed and efficiency of packaging 6-packs of glass containers of beverages into a cardboard container holding 24 bottles.

SUMMARY OF THE INVENTION

The present invention is an improvement on the method of lowering individual units into a larger container, wherein a pusher bar slides the individual units along a dead plate which is positioned above the open-top container.

The pusher bar and the units move along the dead plate until, at an appropriate time, the leading edge of the first 6-pack engages the upper tip of the front panel of the carton, and the pusher bar pushes the individual units off the dead plate where they fall by gravity into the container which may have been pushed along by the 6-packs.

The unique arrangement of the present invention provides a friction-covering on the pusher bar and a pair of trunions or a shaft on which the pusher bar can rotate, as well as a means for rotating the pusher bar at an appropriate moment to cause the pusher bar to rotate against the backside of a pre-packaged unit, whereby to accelerate the vertical fall of the rear end of the pre-packaged unit, so that the rear end of the pre-packaged unit "catches up" with the front end thereof, which has already begun to drop vertically away from the dead plate.

With the above and other objects in view, further information and a better understanding of the present invention may be achieved by referring to the following detailed description:

DESCRIPTION OF THE PREFERRED EMBODIMENT

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts:

U.S. Pat. No. 3,466,834; 3,599,397 and 3,377,774 show the construction and arrangement of a well-known packaging unit, such as a "Diplomat" packager, manufactured by the Nigrelli Systems Inc., and which incorporate their "SOF-LOAD" arrangement. "SOF-LOAD" is a registered trademark of the Nigrelli Systems Inc. These patents are incorporated herein by reference.

Figure 1:
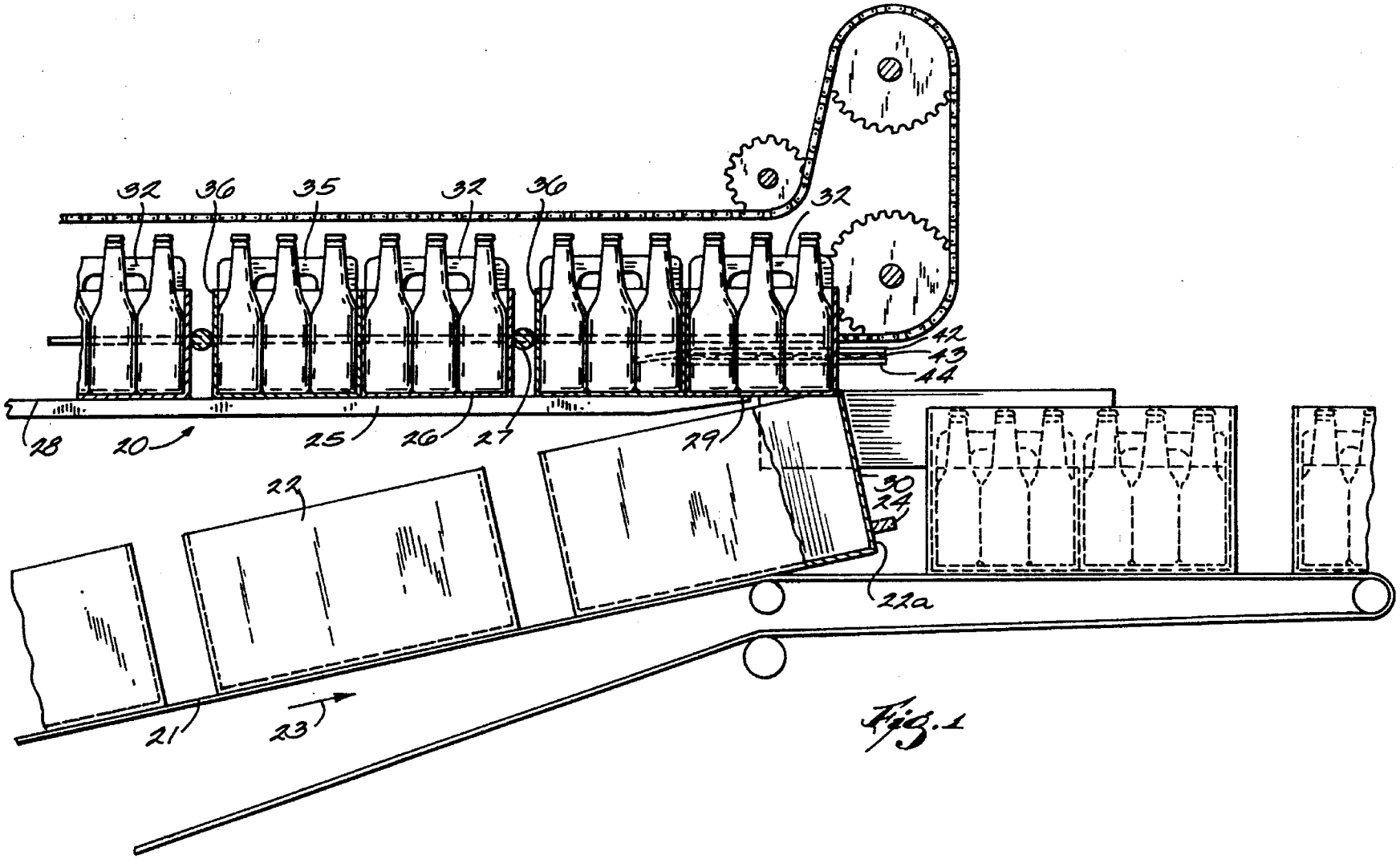
FIG. 1 is a schematic side elevational view of a packaging unit utilizing the unique pusher bar of the present invention.
Figure 3:
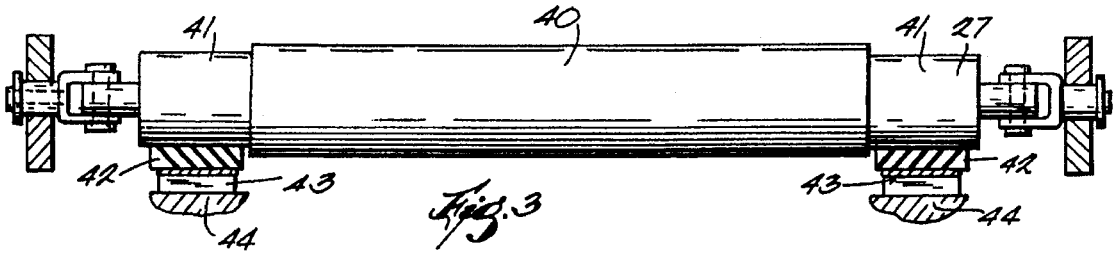
FIG. 3 is a front elevational view of the pusher bar showing the trunions resting on the friction plates.

Referring now to FIG. 1, there is shown the packaging unit 20 with a lower conveyor arrangement 21 on which a plurality of cardboard cartons 22 are moved in the direction of the arrow 23. The carton may have top flaps (not shown) spread apart so that the carton 22 is in a position to have the contents deposited therein.

On an upper conveyor 25, a plurality of 6-pack cartons 26 are moved by pusher bars 27 in groups of 4 along a dead plate or sliding plate, or load plate 28.

Near the end 29 of the dead plate 28, the cartons 22 have been moved by the lower conveyor 21 until the lower leading edge 22-*a* of the carton hits a stop 24 and the carton comes to rest with the inner upper leading edge 22-slightly above and in front of the end 29 of the dead plate 28 on which the 6-packs have been pushed by a pusher bar.

This brings the front edge 30 of a carton 22 in alignment with the lower front edges 31 of a pair 32 of 6-packs. With continuous movement of the 6-packs under the impetus of the pusher bar, the first two side-by-side 6-packs are pushed off the dead plate with the carton moving therebeneath. The first two 6-packs start to fall into the carton 22 with the front edge 31 of the leading 6-packs against the inside of the front edge 30 of the carton.

Figure 4:
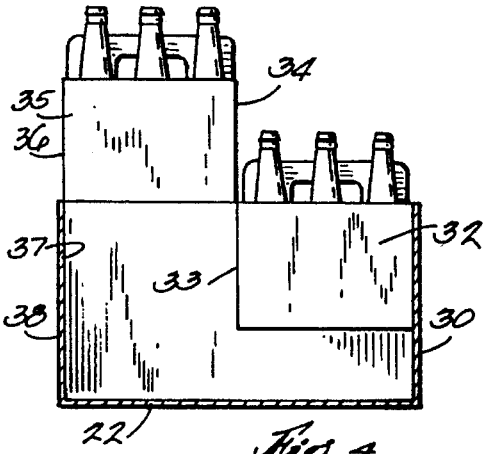
FIG. 4 and 5 are schematic diagrams showing a problem which arises when two of the 6-pack units are "cocked" in a corrugated container.

As is shown in FIG. 4, this pair 32 of 6-packs falls vertically into the carton, with the rear ends 33 of the front pair 32 dropping faster than the front ends 34 of the rear pair 35, also as is shown in FIG. 4.

Figure 5:
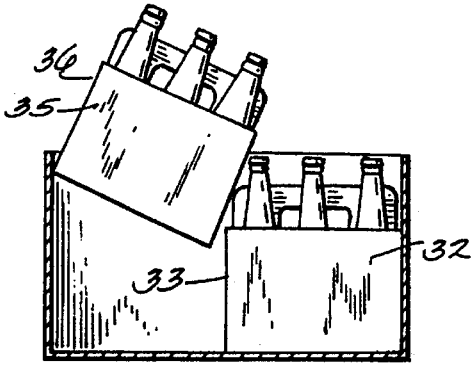

This causes a "cocking" of the second pair 35 against the upper edge of the rear 33 of the front pair 32 as is shown in FIG. 5.

This unfortunate arrangement prevents the container from being properly loaded and causes a disruption in the packaging operation with subsequent damage, loss of time, and inefficient operation and unnecessary expense.

So that the second pair 35 can fall "squarely" into the container 22, the pusher bar 27 is provided with a friction cover 40 which comes into contact with the backsides 36 of the rear pair 35 of the 6-pack.

Figure 2:
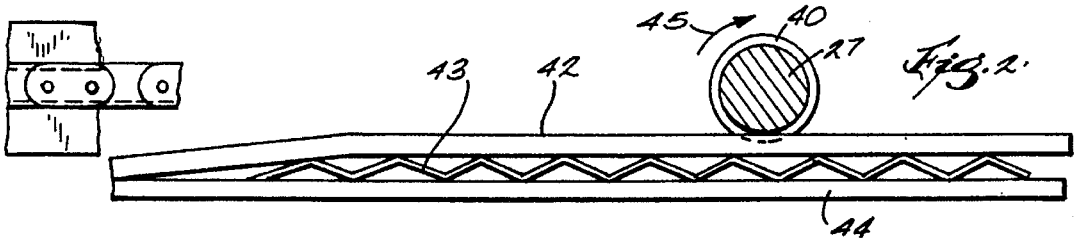
FIG. 2 is an enlarged view of the friction device to cause the rotation of the pusher bar.

For the greater part of the movement of the pusher bar and of the four 6-packs along the dead plate 28, the pusher bar does not rotate, but as the pusher bar approaches the end 29 of the dead plate 28, the trunions (or axle) 41 ride upon a stationary friction plate 42 which is urged in an upward direction from a support 44 by a spring 43 (or other device such as a pneumatic load, etc.), to provide a surface upon which the axle 41 may not slide but is caused to roll, thus rotating the pusher bar 27 (against the outside 36 of backside of the second of the pair of 6-packs) in a clockwise direction as shown by the arrow 45 in FIG. 2.

Figure 6:
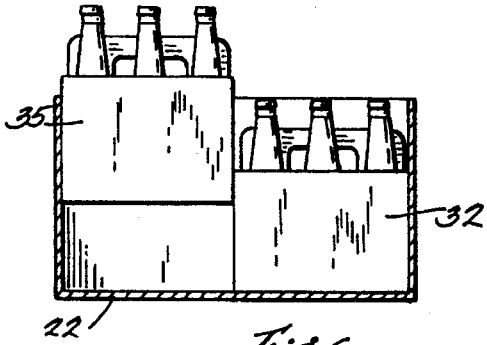
FIG. 6 illustrates how the rotating pusher bar of the present invention aligns two of the 6-pack units.

This causes a downward force to be exerted against the outside 36 of the backside, and although the friction cover 40 merely slips against the outside 36 while the second pair 35 of the 6-packs is still on the dead plate 28, as soon as the rear edge of the last pair of 6-packs passes beyond the edge 29 of the dead plate 28, the friction roller action of the pusher bar 27 causes the back side of the second pair of 6-packs to move downward more rapidly and to "catch up" with the already falling front edge thereof, so that the second pair of 6-packs is "square" with the first pair of 6-packs as shown in FIG. 6.

Figure 7:
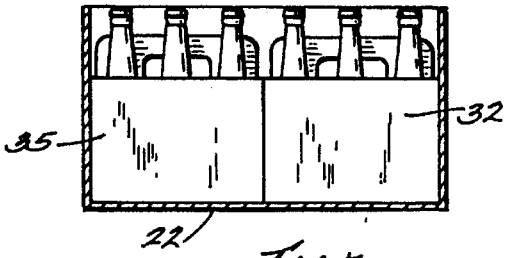
FIG. 7 shows how the 6-pack units are properly nested in the cardboard container.

The second pair 35 of 6-packs can slide downwardly between the rear end 33 of the front pair 32 of 6-packs and the inside 37 of the back 38 of the container 22, so that the second pair is properly loaded, as is shown in FIG. 7.

All of the foregoing arrangement is carefully designed and constructed so as to accommodate the subject matter and contents of the 6-packs. This is particularly important if the items to be lowered are glass bottles or other breakable material, and when one considers that each bottle of beer or similar beverage weighs about 1.4 lbs. and a 6-pack weighs about 8.5 lbs., and the 6-packs are moving at 160 units per minute, to assemble and fill 40 of the cardboard cases per minute on a conveyor which is operating at in excess of 100 ft. per minute, such a unique arrangement of the present invention is economically desirable and commercially significant.

Thus it can be seen that there is provided a process and apparatus which is an improvement on a well-known packaging device, which is inexpensive to construct, easy to operate, and of great commercial significance.

It is furthermore to be understood that the present invention may be embodied in other specific forms without departing from the spirit or special attributes; and it is, therefore, desired that the present embodiments be considered in all respects as illustrative and, therefore, not restrictive, reference being made to the appended claims rather than to the foregoing description to indicate the scope of the invention.

Having thus described the invention, what is claimed as new and desired to protect by Letters Patent are the following:

1. An apparatus for pushing individual units into a container, said container having a first end and each said unit having a front end and a back end wherein the individual units are moved on a first surface having an end, said apparatus including:

at least one pusher bar which contacts the back end of an individual unit and moves it along said surface, means for rotationally actuating said pusher bar while in contact with the back end of a unit, so as to accelerate the downward movement of the individual unit when the back end of the unit passes the end of said first surface to fall from the first surface into the container.

2. The apparatus of claim 1 including a second surface on which said container is moved beneath said first surface, a stop near the end of said second surface, which prevents movement of said container therealong when said first end of said container has passed beneath the end of said first surface.

3. The apparatus of claim 1 including a second surface on which said container is moved beneath said first surface, and timing means to control the speed of movement of the individual unit on the first surface and of the container on the second surface.

4. The apparatus of claim 2 including means whereby said stop can be overridden to permit continued movement of said container when the front end of said unit is pushed against the first end of said container.

5. The apparatus of claim 1 wherein said pusher bar includes a friction element which causes and said pusher bar to rotate while the pusher bar is in contact with the rear end of said unit.

6. The apparatus of claim 5 wherein said friction element includes a spring-loaded surface, on which said pusher bar rolls, causing said pusher bar to rotate when said pusher bar is near the end of said first surface.

7. The apparatus of claim 5 wherein said pusher bar is carried by a belt arrangement in a manner so as not to cause rotation of said pusher bar until said pusher bar is in contact with said friction element.

8. The method of loading individual units into a container, which includes:

supplying a container with an open top, supplying an individual unit to be placed in said container, moving said container beneath said individual unit, providing a pusher bar for pushing said individual unit into said container, rotating said pusher bar while it is in frictional contact with said individual unit as said individual unit is pushed into said container to accelerate movement of said unit into said container.

* * * * *